United States Patent [19]

Planck

[11] 4,306,594

[45] Dec. 22, 1981

[54] VACUUM ASSIST FUEL SYSTEM

[75] Inventor: Richard E. Planck, Poughkeepsie, N.Y.

[73] Assignee: Texaco Inc., White Plains, N.Y.

[21] Appl. No.: 195,031

[22] Filed: Oct. 8, 1980

Related U.S. Application Data

[63] Continuation of Ser. No. 58,641, Jul. 19, 1979, abandoned, which is a continuation of Ser. No. 855,654, Nov. 30, 1977, abandoned.

[51] Int. Cl.[3] ..... B65B 3/18

[52] U.S. Cl. ..... 141/59; 141/290; 141/302

[58] Field of Search ..... 55/88, 387; 141/4, 5, 141/44–46, 52, 59, 65, 93, 290, 301, 302, 392; 220/85 VR, 85 VS

[56] References Cited

U.S. PATENT DOCUMENTS 4,082,122 4/1978 McGahey ..... 141/59 X

*Primary Examiner*—Frederick R. Schmidt

*Attorney, Agent, or Firm*—Carl G. Ries; Robert B. Burns

[57] ABSTRACT

A balanced system for transferring a volatile liquid fuel into a tank therefor while avoiding passage of fuel vapors into the atmosphere. Vacuum assist means is provided in the system to compensate for lack of integrity of the fit between a removable fuel dispensing nozzle and the tank filler tube. The system includes a vapor pump to carry vapor from the tank being filled, and a valved bypass means to conduct liquid away without impairing vapor passage. The system also includes a check valve in the vapor passage to prevent escape of vapors during periods of non-use. The system further includes a trim valve connecting the vapor pump outlet to the vapor pump inlet so that the desired vapor/liquid exchange ratio can be attained during calibration.

3 Claims, 1 Drawing Figure

VACUUM ASSIST FUEL SYSTEM

This is a continuation of application Ser. No. 058,641, filed July 19, 1979, now abandoned, which is a continuation of application Ser. No. 855,654, filed Nov. 30, 1977, now abandoned.

BACKGROUND OF THE INVENTION

During the transfer of a volatile liquid such as gasoline or a similar fuel from a storage facility, there is normally an unsealed connection made between the disconnectable nozzle and the tank being filled. As the transfer operation progresses, residual gases contained in the tank, as well as air, normally rise into the atmosphere.

Many municipalities and governmental agencies have proposed or adopted regulations intended to reduce or at least control these emissions. One method toward complying with mandated regulations is the provision of a completely closed system between the fuel source or storage facility and the tank being filled.

Such a closed system normally includes a conduit which carries fuel, having a manually operated dispensing nozzle attached to the conduit remote end. The latter is adapted to be removably positioned in the filler pipe of the receiving tank. It further includes means to form a sealed engagement between the nozzle spout and the tank filler tube.

Also in many instances, a system of the type contemplated is not entirely closed in a true sense, but rather is vented to the atmosphere. With such an arrangement, as liquid is pumped from the storage facility, either of two eventualities could occur. If fuel leaving the system is not immediately replaced by vapor from the tank being filled, air will be drawn into the system. On the other hand, when excessive vapors are drawn from the tank being filled, some will have to be vented. However, these exiting fumes will first be treated such that their discharge is not harmful to the environment.

Several embodiments of nozzle sealing arrangements have been found to be advantageous for providing the necessary vapor tight, yet disconnectable connection at the nozzle spout. One method for providing the desired seal is to attach a cylindrical, flexible walled member such as a rubber boot or the like, to the fuel dispensing nozzle. The boot in such a position will substantially surround the nozzle spout when the latter is in place.

By use of such an arrangement, when the nozzle is received in the filler pipe of the receiving tank, the walls of the flexible boot will be deflected and/or distorted. The boot will thereby define an annular vapor passage while the resilient contact edge thereof sealably engages the tank filler pipe.

This type of arrangement has generally been found to be highly effective. Thus, when a fuel flow is introduced from the nozzle into the receiving tank, normally a slight pressure is produced within the tank. This pressure will displace fuel vapors as well as air.

The displaced vapors will be urged upwardly through the annulus defined by the nozzle spout and the flexible member. Said vapors can then be transferred by way of the dispensing nozzle through a separate conduit, to the fuel source, or to another reservoir for retaining the vapors.

The effectiveness of this system depends to a large degree on the mechanical compatibility of the vehicle with the nozzle, i.e., to permit a tight seal at their interface. If for any reason the contact edge of the nozzle boot cannot firmly engage the filler pipe, a seal cannot be achieved, and a leak will result or develop.

The presently disclosed arrangement is designed to reduce the unfavorable effect of such leaks by applying a slight vacuum within the nozzle boot. The vacuum assists the vapor transfer toward the intended storage means. In the presently disclosed arrangement, a system is provided which incorporates a number of features including: (1) a removable seal at the vehicle-nozzle interface for those vehicles which permit such a seal; (2) a vacuum assist device adapted to aid in collecting vapors from those vehicles which cannot be completely sealed, and (3) the use of a vapor pump, which is driven in response to the flow of dispensed fuel, to carry off fumes.

Said pump is driven by a hydraulic motor within the system, thereby to substantially regulate the volume of vapor which is moved, in relation to the volume of fuel dispensed. The system further contemplates a valved bypass conduit which opens in response to an accumulation of liquid in the vapor system, and which returns said liquid to the main tank or reservoir.

Toward assuring the operation of the overall system under varying circumstances, the valved bypass conduit is provided across the positive displacement vapor pump to pass vapors directly to the pump outlet side if conditions require, and to keep liquid out of the vapor pump. Toward that same end, the vapor pump outlet is communicated, through an adjustable valve, to the vapor pump inlet so that the desired ratio of gases ingested at the nozzle with respect to the amount of liquid dispensed can be adjusted to some pre-selected ratio at the time of calibration. Further, a one-way mechanism may be installed in the vapor pump inlet line to prevent vapors from escaping when the dispensing system is not being operated.

An object of the invention therefore is to provide a vaporizable fuel system which embodies an effective sealing means disposed between the fuel dispensing nozzle and a receiving tank. A further object is to provide a balanced fuel system of the type contemplated which is enhanced in response to the inflow of fuel to the receiving tank. A still further object is to provide a vacuum assist arrangement within a fuel system having a dispensing nozzle, which assistance is adjusted in response to the flow of gasoline to the tank being filled, and to the volume of vapor which is displaced from the tank during the operation.

DESCRIPTION OF THE DRAWING

The drawing represents an environmental arrangement of the presently disclosed closed fuel system which connects an underground storage tank with a receiving tank to be filled, such as would be contained on an automobile, boat or the like.

The invention in brief, and referring to the drawing, comprises a fuel storage tank 10 of the type normally found in a vehicle service station. An electrically driven gasoline supply pump 11 is adapted to be actuated for removing a stream of gasoline or similar volatile liquid by way of conduit 12. Said pump 11 can be located at the ground level and is as shown, enclosed by a casing 14 or the like. Said pump 11 can be located closer to or farther from or within tank 10.

Figure 1:
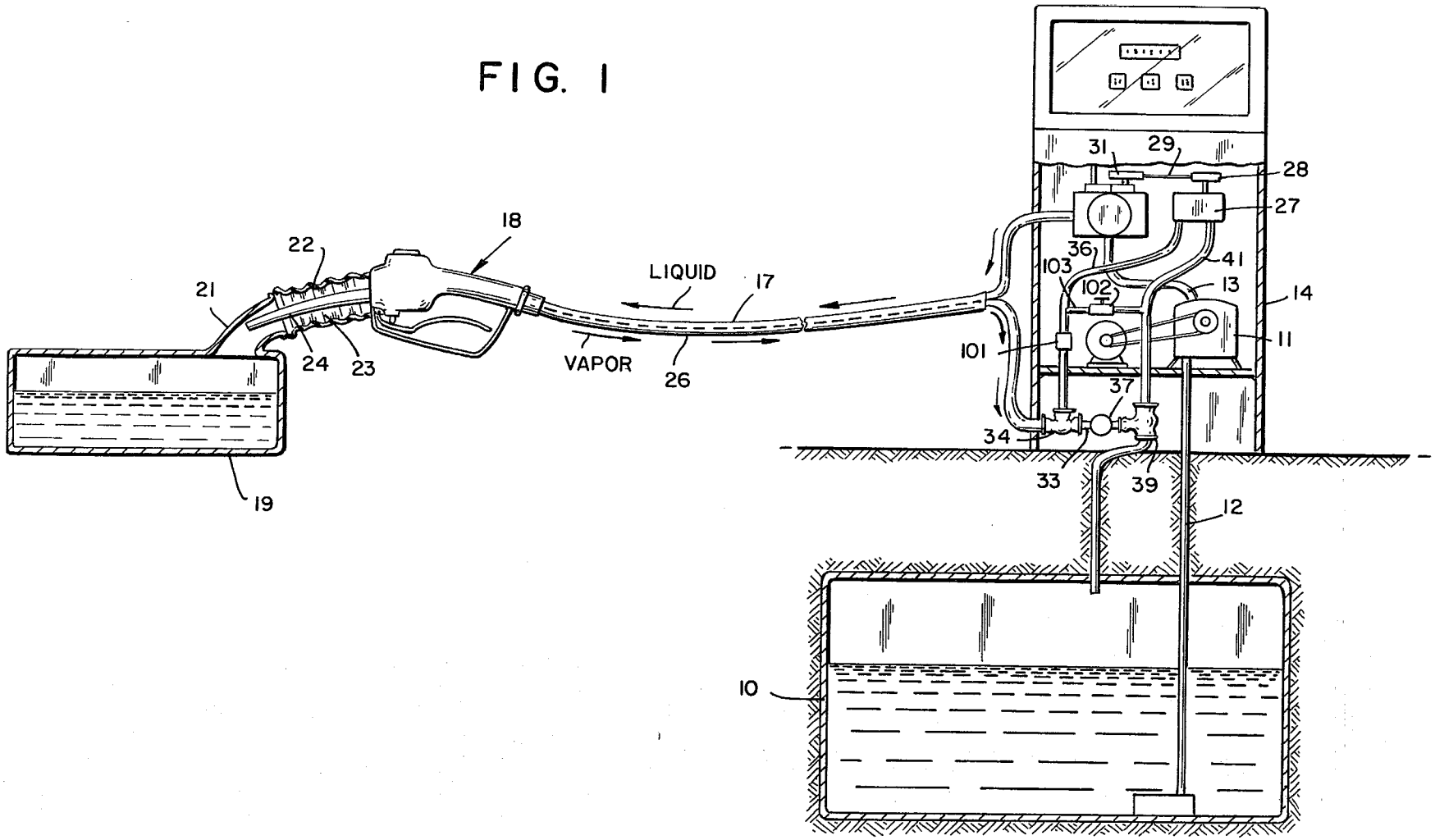

Pump 11 discharges by way of conduit 13 into the inlet port of a hydraulic motor 16. The latter is in turn communicated through an elongated conduit 17 by way of a dispensing nozzle 18, to a fuel tank 19.

Pump 27 is driven through pulley 28, which is in turn connected by a drive belt 29 to pulley 31. Motor 16 is communicated with a mechanism for visibly registering the flow of fuel which passes therethrough such that the transaction is visible to a customer as well as to the operator.

The fuel dispensing system herein generally described is one that is normally found in a majority of modern automotive service stations. They provide in effect means to transfer fuel to a vehicle, while simultaneously visibly registering the volume flow as well as the cost of the fuel.

The presently disclosed apparatus including pump 27, pump bypass 33, check valve 101 and adjustable valve 102, is such that it can be readily incorporated into the above noted fuel dispensing systems without unduly affecting the normal operation of the latter.

The instant arrangement is thus adapted to afford an efficient, balanced fuel system through the incorporation of vapor pump 27, while avoiding the possibility of returning liquid accumulating at a point in the system where it might interfere with the pump's operation.

The desired results are obtained through use of valved bypass conduit 33. Said member is disposed preferably at the lowest possible position in the fuel system. It is thus adapted to drain liquid while permitting vapor to be circulated through pump 27.

Bypass conduit 33 includes in essence a T fitting 34, one opening of which is communicated with vapor carrying conduit 26. Another opening of the fitting is communicated with the inlet of pump 27 by way of conduit 36. The third, or downstream connection of T fitting 34 communicates with the upstream or inlet side of valve 37.

The latter comprises a check valve which incorporates a counterbalanced flapper member 38. Said member is hinged at the upper side to permit it to be displaced for passing liquid fuel therethrough. Functionally, valve 37 will also pass vapor therethrough in the event of a severe build-up of pressure from tank 19 which pressure is not relieved through the action of pump 27.

The downstream side of conduit 33 includes a second T fitting 39 having one inlet communicated to receive liquid from valve 37. A second inlet of fitting 39 is communicated with the discharge port of pump 27 by conduit 41. Said T fitting 39 is further communicated with reservoir 10 to pass both vapor and liquefied fuel to the latter, as it comes from either pump 27, or from valve 37. Check valve 101 may be located in conduit 36 between T fitting 34 and pump 27. Check valve 101 may not be required for those installations wherein dispensing nozzle 18 contains a check valve. Joining conduit 41 and conduit 36 is conduit 103 containing adjustable valve 102.

Operationally, the subject apparatus functions essentially in the manner of an ordinary service station installation in that it is capable of transferring a stream of vaporizable fuel from a reservoir to a mobile tank such as that of an automobile or boat. However, the apparatus is further adapted to conduct vapors which are forced from the mobile tank, back to the storage reservoir or to an alternate facility.

Thus, during the fuel transfer operation, nozzle 18 is registered sufficiently within inlet 21 of tank 19 to form a substantially fluid tight seal with the inlet walls. This is achieved by urging the nozzle 18 into inlet 21 such that the resilient boot 22 is deformed in an attempt to define a fluid tight connection with the inlet pipe outer lip. However, a fluid tight connection is not a prerequisite to satisfactory operation of the subject apparatus.

Normally, and with the herein disclosed device if desired, the nozzle 18 is self-sustaining once it is inserted into the tank 19. This is achieved by any of several means characteristic of a fuel nozzle to hold it in place during the entire transfer operation.

The actual transfer flow is instituted by actuation of pump 11 through an external, electrically powered means. Thereafter, as fuel commences to flow through the system, displacing the nozzle actuating lever will introduce the flow of liquid fuel into tank 19. As the liquid level rises within the tank, the vapor will be displaced there and caused to flow back through nozzle 18 and conductor 26.

This vaporous flow will depend to a large extent upon temperature conditions of the fuel in reservoir 10 and in tank 19. For example, under certain temperature conditions there would be virtually no vapor flow from tank 19 back through vapor conductor member 26.

In other instances such as where the temperature within tank 19 is elevated with respect to the temperature of incoming fuel, there could be an excessive amount of vapor from tank 19, through conductor 26, and eventually deposited in reservoir 10.

Thus, vapor pump 27 is drivingly connected to the registering mechanism 16 such that said pump 27 is actuated to a speed responsive to the passage of fuel through motor mechanism of registering mechanism 16. Pump 27 will therefore be driven at varying speeds in accordance with the flow of liquid entering the tank 19.

To best circulate vapors from tank 19 into the reservoir member 10, bypass member 33 is provided. Since some of the returning vapor tends to condense along the return path, bypass 33 will function to permit only a limited accumulation of liquid. Further, it will permit the passage of such liquid directly into reservoir 10 rather than permit the liquid to accumulate at a low point in the system, thereby blocking the flow of vapor from tank 19.

Thus, with the liquid or condensed fuel being freely passed into reservoir 10 the vapor leaving conduit 26 is passed from T fitting 34, through conduit 36, through check valve 101, and into the vapor pump 27. From the latter, the major portion of the vapor is forced through conduit 41 and T fitting 39 to be introduced into reservoir 10. The remaining portion of the vapor exiting from vapor pump 27 is forced into conduit 103, through valve 102 which has been preadjusted, and back into the inlet port of vapor pump 27. Valve 102 is adjusted during calibration of the vapor recovery system such that, for each gallon of liquid dispensed, the desired amount of vapor is ingested through nozzle 18. The valve may include a tamper-proof mechanism or the valve handle may be removed after calibration.

In that the displaceable member in check valve 37 moves in only one direction to open in response to pressure at the upstream side, it is clear that an excessive build-up of vapor that cannot be handled by pump 27 will tend to open said valve 37. This will permit vapor flow directly through the bypass member 33 as well as through vapor pump 27.

Other modifications and variations of the invention as hereinbefore set forth can be made without departing from the spirit and scope thereof, and therefore, only such limitations should be imposed as are indicated in the appended claims.

I claim:

1. In an apparatus for transferring a vaporizable liquid fuel from a reservoir 10 therefor, into a mobile tank 19, and for concurrently directing vapors from said mobile tank 19 into said reservoir 10 as the liquid level in tank 19 rises, and including; first pumping means 11 having an inlet communicated with the vaporizable liquid in said reservoir 10, and having a first pumping means discharge outlet, flow regulating means 16 including a hydraulic motor having a motor inlet communicated with said first pumping means 11 to receive a stream of liquid from the latter, and having a hydraulic motor outlet, conduit means including liquid and vapor carrying conductors 17 and 26, a discharge nozzle 18 connected to an end of said respective liquid and vapor carrying conductors 17 and 26, and being adapted to removably engage said mobile tank 19 in a vapor tight joint to permit liquid from between said discharge nozzle 18 and said tank 19 while avoiding escape of vapor through said vapor tight joint, a vapor pump 27 having a vapor inlet and vapor outlet respectively, said vapor pump inlet being communicated with said vapor carrying conduit 26 to receive a stream of vapor from the latter, and a vapor pump bypass means 33 communicating said vapor pump 27 inlet with said vapor pump outlet, the improvement therein of:

check valve means 37 disposed in said vapor pump bypass means 33, and being communicated with said reservoir 10 to prevent liquid from entering said vapor pump 27, by directing said liquid into said reservoir 10, check valve means 101 communicating said vapor conduit 26 with said vapor pump 27 inlet and being operable to avoid vapor flow into the conductor 26 from said pump 27, and conduit means 103 communicating said vapor pump inlet with the outlet thereof, and having a flow control valve 102 disposed in said conductor 103, said flow control valve 102 being adjustable to regulate the amount of vapor which flows from the vapor pump 27 outlet to the inlet thereof.

2. In an apparatus as defined in claim 1, wherein said check valve means 37 includes a displaceable member which is operable to be displaced in response to a liquid accumulation at the upstream side of said valve.

3. In an apparatus as defined in claim 2, wherein said check valve means 37 is disposed at an elevation intermediate said reservoir and said vapor pump means.

* * * * *